United States Patent [19]

Coy

[11] Patent Number: 4,836,404

[45] Date of Patent: Jun. 6, 1989

[54] VALVED CONTAINER CLOSURE

[76] Inventor: Peter Coy, 2677 South Ave., Box 229, Bryn Athyn, Pa. 19009

[21] Appl. No.: 207,293

[22] Filed: Jun. 15, 1988

Related U.S. Application Data

[63] Continuation of Ser. No. 152,537, Feb. 5, 1988, Pat. No. 4,782,975.

[51] Int. Cl.[4] ..... A47F 19/22

[52] U.S. Cl. ..... 220/90.4; 222/488; 222/490

[58] Field of Search ..... 220/90.2, 90.4, 90.6, 220/254; 215/74, 11.4, 11.5, 11.1; 222/490, 488, 212, 527, 213; 229/7 R

[56] References Cited

U.S. PATENT DOCUMENTS

| | | | |
|---|---|---|---|
| Des. 165,778 | 1/1952 | Olsen | D36/D8 |
| 2,040,545 | 5/1936 | Byers | 215/74 |
| 2,611,515 | 9/1952 | Smith | 222/213 |
| 2,622,420 | 12/1952 | Rice | 65/13 |
| 2,816,548 | 12/1957 | Tupper | 128/252 |
| 3,104,787 | 9/1963 | Thompson, Jr. | 222/490 |
| 3,165,241 | 1/1965 | Curry | 222/490 |
| 3,191,820 | 6/1965 | Kuster | 222/490 |
| 3,739,938 | 6/1973 | Paz | 220/90.4 |
| 4,121,731 | 10/1978 | Okerstrum | 220/90.4 |
| 4,133,457 | 1/1979 | Klassen | 220/490 |
| 4,239,123 | 12/1980 | Lang et al. | 220/90.6 |
| 4,345,695 | 8/1982 | Galloway et al. | 220/254 |
| 4,350,260 | 9/1982 | Prueher | 220/254 |
| 4,428,498 | 1/1984 | Obey | 220/367 |
| 4,596,341 | 6/1986 | Bruffey | 220/904 |
| 4,623,069 | 11/1986 | White | 215/11.4 |
| 4,640,424 | 2/1987 | White | 215/11 R |
| 4,714,173 | 12/1987 | Ruiz | 220/90.4 |

*Primary Examiner*—George T. Hall
*Attorney, Agent, or Firm*—Volpe and Koenig

[57] ABSTRACT

A closure for containers particularly adapted for use in dispensing liquid beverages. The closure includes a spout for delivery of the liquid beverage, and the spout is provided with a flow control valve housed within the spout. The valve and spout are formed of resilient materials, and the valve is normally closed, but is openable by lip pressure applied externally of the spout.

3 Claims, 2 Drawing Sheets

VALVED CONTAINER CLOSURE

This is a continuation of application Ser. No. 152,537, filed Feb. 5, 1988 now U.S. Pat. No. 4,782,975.

BACKGROUND AND STATEMENT OF OBJECTS

This invention relates to a closure for a container and is particularly concerned with containers as employed in the so-called fast food industries. Containers of this type are commonly provided with a cup or body and a closure lid. In some arrangements, it is contemplated to remove and discard the lid when access is desired to the food or other material to be supplied in the container. In some instances, a container lid is employed having a deflectable or removable area adapted to be used either directly for drinking or adapted to be opened for insertion of a drinking straw.

In general, prior art arrangements of the kind referred to are not adapted to be reclosed or resealed after they have been opened for use; and in consequence, in the absence of exercise of special handling care, the liquid or material in the container is subject to being inadvertently spilled after the original closure is deflected or disturbed.

It is a major objective of the present invention to provide a closure for a container, particularly adapted to handle liquids, and in which a drinking spout is provided, the drinking spout not only having an aperture for withdrawal of the contained liquid, but also having a valve therein adapted to close when the liquid is not being withdrawn through the spout.

It is a further object of the present invention to provide an arrangement of the kind above referred to in which the valve in the spout is operable by engagement of the lips of the user with the exterior of the spout, thereby providing for automatic opening of the spout when the user desires to withdraw liquid from the container through the spout, and also providing for automatic closing of the valve in the spout when the lips of the user are again separated from the spout.

In addition to the foregoing, it is a further objective of the invention to provide an initial closure tab associated with the spout in relation to the valve so that for purposes of shipment and handling, the closed container will remain substantially sealed until the closure tab is intentionally removed.

BRIEF DESCRIPTION OF THE DRAWINGS

How the foregoing objects and advantages are attained will appear more fully in the following description of the drawings, in which.

DETAILED DESCRIPTION OF THE DRAWINGS

Figure 1:
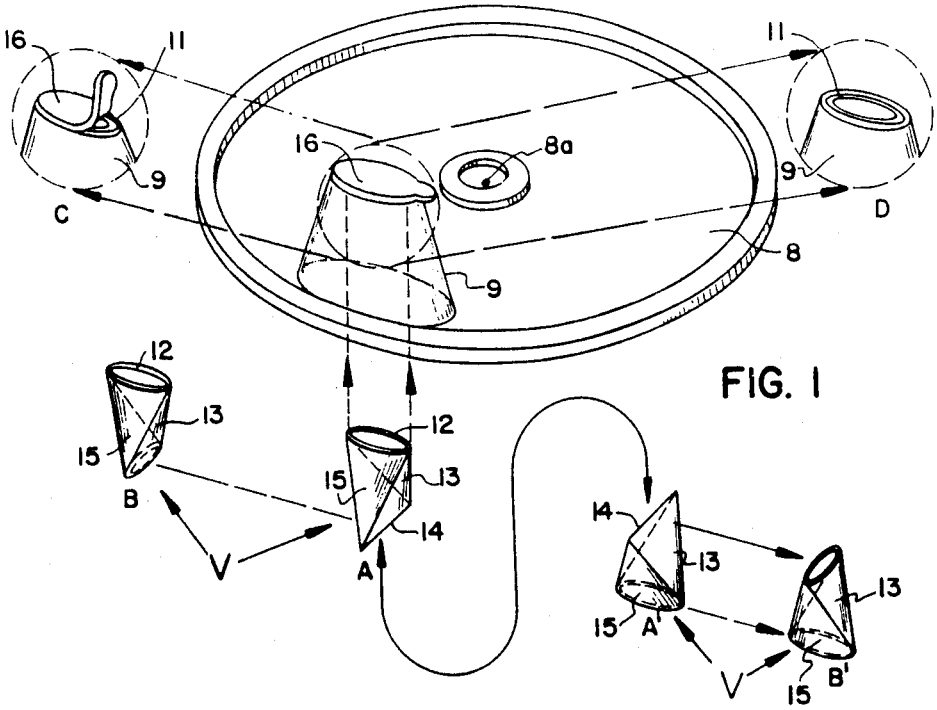
FIG. 1 is an overall perspective view of a lid or closure or container according to the present invention, the lid having a spout adapted to surround or house a control valve, the valve being illustrated in FIG. 1 in separated relation to the lid in several positions below the illustration of the lid itself, as will be explained more fully hereinafter.
Figure 2:
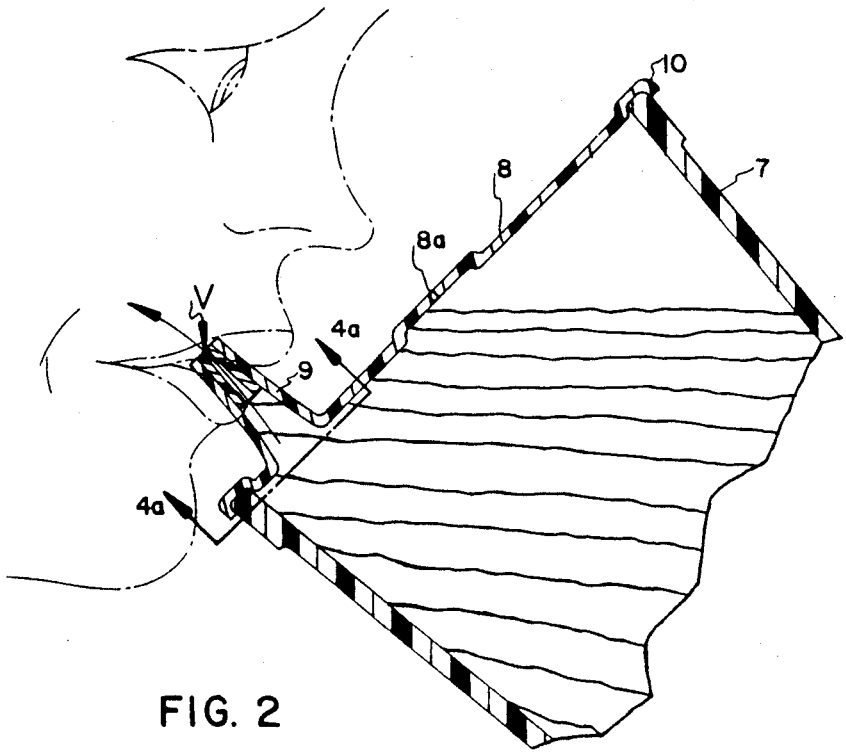
FIG. 2 is a fragmentary sectional view of the upper portion of a cup having a closure or lid according to the present invention, including the spout and the interior valve, this figure showing the valve in opened position, as a result of engagement of the lips of a user.
Figure 3:
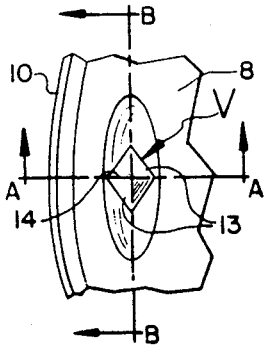
FIG. 3 is a fragmentary view taken as indicated by the section line 3—3 applied to FIG. 2, but showing the parts disengaged from a user and with the interior valve in closed position.
Figure 3A:
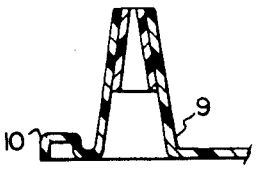
FIGS. 3A and 3B are sectional views taken as indicated by the sections lines A—A and B—B applied to FIG. 3.
Figure 3B:
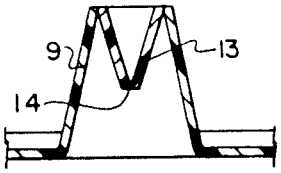
Figure 4:
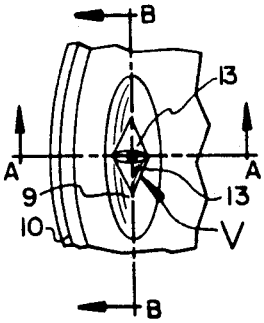
FIG. 4 is a view similar to FIG. 3 taken as indicated by the section line 3—3 applied to Figure 2, but FIG. 4 shows the valve in opened condition.
Figure 4A:
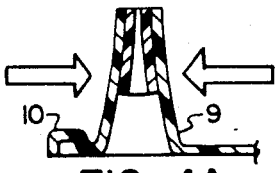
FIGS. 4A and 4B are sectional views taken as indicated by the section lines A—A and B—B applied to FIG. 4, these sectional views also showing the valve in opened condition.
Figure 4B:
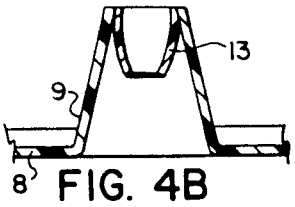

Referring first to FIGS. 1 and 2, the container is indicated by the reference numeral 7, and the lid for the container is indicated at 8. The container may be formed of any desired material, quite commonly a sheet plastic or molded foamed plastic or paper or cardboard; and the lid may also similarly be formed of materials of the same type. In embodiments such as herein illustrated, in which the spout 9 is integrally molded or formed with the remainder of the lid 8, it is preferred that the material employed have the characteristics of sheet material having substantial flexibility and resiliency so that the spout may readily be compressed by the lips of the user, for the purposes fully described herebelow. As is customary with lids of the kind referred to for containers of the kind referred to, the lid ordinarily has a peripheral groove or socket 10 adapted to receive and interengage with the upper edge of the cup 7 itself.

The spout 9 is connected with the lid and the spout has a flow passage between the interior and the exterior of the cup; and preferably, this flow passage is of ovoid cross section and also of progressively reduced dimensions from the surface of the lid 8 upwardly to the delivery opening 11 (see the figure details indicated by the letters C and D associated with FIG. 1).

Although the spout 9 and the lid may be separately formed or molded and then interconnected, they may also, as is disclosed in FIGS. 1-4, be integrally molded with the remaining structure of the lid.

With the foregoing description of the general arrangement of the lid and the spout in mind, attention is now directed to the four illustrations marked A, B, A′, and B′, these illustrations showing the interior control valve indicated generally by the letter V. This valve is positioned within the spout 9 but is shown in exploded relation to the spout in the illustrations marked A, B, A′ and B′. Certain details of the valve are also more fully disclosed in Figures 3, 3A, 3B, 4, 4A and 4B.

The valve is preferably formed of flexible and resilient material, for example, synthetic rubber compositions. The valve has an upwardly presented opening of ovoid shape similar to the ovoid shape of the upper or delivery opening 12 of the spout 9 and fitting just inside of the delivery opening 11 of the spout. The valve further has tapered or inclined surfaces 13—13 (see also FIGS. 3 and 4) converging downwardly and meeting at the lower edge 14 of the valve, as will clearly appear from comparison of Figures A and A' positioned below the main portion of FIG. 1 and also shown in FIGS. 3 and 3B. The valve in opened position is shown in Figures B and B' below the main portion of FIG. 1.

The detail Figure A and A' in the lower part of FIG. 1 shows the valve when in the closed or "at rest" position. The valve is opened by application of lip pressure, as indicated by the arrows at the sides of FIG. 4A, this lip pressure being communicated through the side walls of the spout 9, as clearly appears in FIG. 2, and transmitted through the side walls to the walls 15 of the valve V, which lie between the converging walls 13. When this occurs, the side walls 13 of the valve separate from each other in the manner clearly shown in FIGS. 4, 4A and 4B, thereby opening the valve port along the lower edge of the valve and thus provide communication from the interior of the container upwardly through the spout 9. This provides for delivery of the liquid from the container upwardly through the valve and out of the delivery opening 12 of the valve and thus also out of the delivery opening 11 of the spout 9.

When the lip pressure is again released from the side walls of the spout, the converging walls 13 of the valve again move to close the opening along the line 14 at the lower end of the converging walls 13.

The automatic closure of the valve when the lip pressure is released is not only desirable in order to avoid leakage, but when handling heated liquids, is also advantageous in reducing heat loss of the contents of the container.

The foregoing alternate opening and closing of the valve, as a result of the action of the lips of the user, will be fully apparent from comparison of FIGS. 1, 2, 3, 3A, 3B, 4, 4A and 4B.

The lid 8 is desirably provided with a very small aperture, for instance, in the central region, as indicated at **8*a* in FIGS. 1 and 2**, thereby providing for ingress of air as the contents of the cup are being withdrawn through the valve, and thus prevent development of negative pressure within the cup during delivery of the liquid. An appropriate aperture for this purpose need only have very small cross-sectional dimension and will, therefore, not even result in leakage of the liquid under any normal handling conditions.

In the embodiment of FIGS. 1–4, see particularly the detail indicated at the letter C of FIG. 1, a separable tab 16 is initially provided in position overlying the delivery opening 11 of the spout 9, for the purpose of sealing the container for prepackaged products. This tab desirably has adhesive bonding and is readily manually removable in preparation for use of the container and the valved spout. This tab may alternatively be molded or formed integrally with the spout wall, and arranged for manual separation from the body of the spout.

For effecting the feed operation above described, it is desirable that the spout 9 be formed of sheet material which has some flexibility, and preferably also some resilience so that it will return to the closed position when the lip pressure is released.

The sheet material employed for the valve used within the spout should also be flexible and resilient. This is important so that after opening of the valve by compression under the action of the lips of the user, and subsequent release of the lip engagement, the inclined valve walls 13, which meet along the lower edge 14 when the valve is closed, will return to the "closed" position. When the valve is opened by external pressure applied to the spout, the lower part of the walls 15 move toward each other so that the dimension in the direction of the line 14 is reduced and this causes opening of the valve.

The proportions of the valve itself, and also of the interior of the spout 9, are also configured so as to provide a peripheral sealing interengagement between the outer surface of the valve and the inner surface of the spout in the upper region of the spout and valve. This is important in order to avoid any tendency for leakage from the spout except when the valve is intentionally opened. In the specific embodiments as herein disclosed, it is contemplated that portions of the external surface of the valve itself such as the side walls 15 be adhesively bonded to the interior surface of the spout. With the configurations illustrated in the drawings, this is desirably effected throughout the height of the valve, i.e., throughout the height of the side walls 15. In this way, the rebound of the spout walls after separation of the lips serves to assure reclosing of the valve along the line 14.

As above indicated, the lid and the spout are desirably formed, as by molding, from sheet plastic material. The entire lid, including the spout, may be molded as a single unit or, if desired, the spout and the planar portion of the lid may be separately formed and then interconnected. In any event, the thickness of the material used in the spout should be on the order of from about 0.001" to 0.050", so that the spout may readily be compressed by forces produced by the lip engagement. Compression of the sides of the interior valve V is, of course, also required; and as above indicated, the valve material is desirably resilient, and the thickness of the material used for the valve may also lie within about the range of thickness above referred to for the spout wall.

The wall of the cup 7, on which the lid is employed, may be made of any of a wide variety of materials, one common material used for this purpose being foamed plastic. Material of this type is not only lightweight, but provides adequate strength and rigidity, as is well known.

Figure 5:
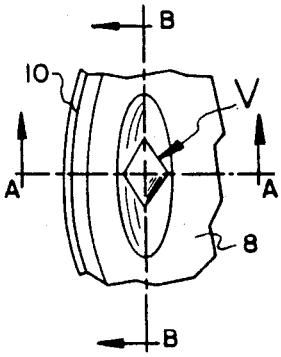
FIGS. 5, 5A and 5B are views illustrating a modification of the arrangement shown in FIGS. 1—4, FIGS. 5A and 5B being taken as indicated by the section lines A—A and B—B applied to FIG. 5 and showing the valve in closed position.
Figure 5A:
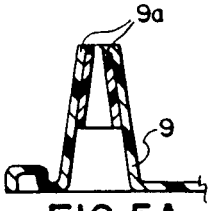
Figure 5B:
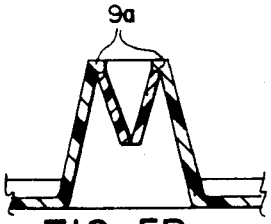

In the alternative embodiment illustrated in FIGS. 5, 5A and 5B, the arrangement of the interior valve and the general configuration of the spout are similar to those described above in connection with the first embodiment. However, in the embodiment of FIGS. 5, 5A and 5B, the upper edge of the spout 9 is provided with an interned flange **9*a*** overlying the upper open end of the valve V. This provides a flange surface for interengagement with the upper edge of the open end of the valve, which may be desirable with certain materials in order to stabilize the valve in the spout.

Figure 6:
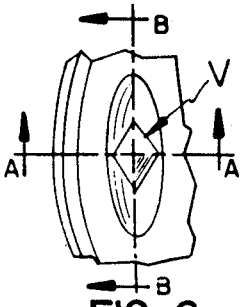
FIGS. 6, 6A and 6B are views of still another embodiment, the views again being similar to FIGS. 3, 3A and 3B, with the sectional views 6A and 6B being taken as indicated by the section lines A—A and B—B applied to FIG. 6 and showing the valve in closed position.
Figure 6A:
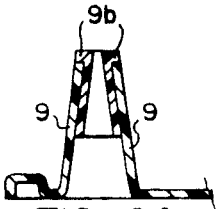
Figure 6B:
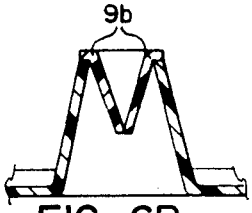

Another alternative for similar purpose sis illustrated in FIGS. 6, 6A and 6B. In this embodiment, the upper edge of the valve is provided with laterally extending flanges **9*b* which overlie the upper edges of the spout 9**; and this will provide a similar stabilizing action in the relation between the valve and the spout.

I claim:

1. A valved spout for use in dispensing a liquid from a container, said spout comprising outer and inner resilient members, said outer member defining the exterior of said spout and having inlet and outlet ends with its inlet end toward the container, said inner member having an open end positioned inside said outlet end of the outer member and a valved end presented in the same direction as the inlet end of the outer member, said valved end of the inner member having opposed planar portions defining a closed valve apex which opens upon application of edgewise lateral compression to said opposed planar positions.

2. A container closure for selectively dispensing a liquid, said closure comprising:

a lid portion for closing an open container and generally defining the top plane of the container, a valved spout integral with and extending from the lid portion above the top plane, said spout comprising:

outer and inner resilient portions nested one within the other;

the outer portion is generally tubular and defines the exterior of the spout, said outer portion has inlet and outlet ends with the inlet end presented toward the container; and the inner portion has an open end presented in the same orientation as said outlet end and a valved end with opposed terminal portions defining a normally closed valve apex yieldingly openable by application of lateral compression in a direction edgewise to said opposed terminal portions.

3. A controllable valve device for use in dispensing a liquid from a container, said device comprising two resilient components nested one within the other; an outer tubular component which is open at both ends and has its first end presented toward the container and an inner component having an open outlet end and a valved end, said outlet end presented in the same direction as the second end of the outer component with the outer wall of said outlet end in circumferential engagement with the inner wall of the outer component and said valved end defining a normally closed valve yieldingly openable by application of lateral compression through the wall of the outer component.

* * * * *

UNITED STATES PATENT AND TRADEMARK OFFICE

CERTIFICATE OF CORRECTION

PATENT NO. : 4,836,404

DATED : June 6, 1989

INVENTOR(S) : Peter Coy

It is certified that error appears in the above-identified patent and that said Letters Patent is hereby corrected as shown below:

Column 4, line 56, delete the word "sis" and insert therefor --is--.

Claim 1, column 5, line 6, delete the word "positions" and insert therefor --portions--.

Signed and Sealed this

Twenty-fourth Day of April, 1990

*Attest:*

HARRY F. MANBECK, JR.

*Attesting Officer*

*Commissioner of Patents and Trademarks*